United States Patent [19]

Birch

[11] Patent Number: 4,979,687

[45] Date of Patent: Dec. 25, 1990

[54] REELING APPARATUS

[75] Inventor: Keith Birch, Wilmslow, Great Britain

[73] Assignee: Francis Shaw & Company (Manchester) Limited, Manchester, England

[21] Appl. No.: 307,327

[22] Filed: Feb. 8, 1989

[30] Foreign Application Priority Data

Feb. 6, 1988 [GB] United Kingdom ..... 8802720

[51] Int. Cl.[5] ..... B65H 67/052

[52] U.S. Cl. ..... 242/25 A

[58] Field of Search ..... 242/25 A, 25 R, 18 A

[56] References Cited

U.S. PATENT DOCUMENTS

| | | | |
|---|---|---|---|
| 2,929,569 | 3/1960 | Detrick et al. | 242/25 A |
| 3,064,912 | 11/1962 | Bittman | 242/25 A |
| 3,368,765 | 2/1968 | O'Grady | 242/25 A |
| 3,596,844 | 8/1971 | Engmann | 242/25 A |
| 4,119,278 | 10/1978 | Draizen et al. | 242/25 A |
| 4,291,841 | 9/1981 | Dalrymple et al. | 242/225 A |
| 4,369,928 | 1/1983 | Riekkinen et al. | 242/25 A |
| 4,438,886 | 3/1984 | Meisser et al. | 242/25 A |
| 4,451,008 | 5/1984 | Veyrassat et al. | 242/25 A |
| 4,643,368 | 2/1987 | Hattersley, Jr. | 242/25 A |

*Primary Examiner*—Stanley N. Gilreath

*Attorney, Agent, or Firm*—Salter & Michaelson

[57] ABSTRACT

A cable reeling apparatus includes a plurality of reeling stations, a reel at each reeling station and a winding mechanism at each station for winding a cable onto the reel at the same station. The apparatus further includes a guide mechanism for selectively guiding the cable onto a first one of the reels and for transferring winding to a second reel when a sufficient length of cable has been wound on the first reel. The apparatus further includes an eccentric at each station for generating a loop in the cable when winding is commenced at a station.

9 Claims, 7 Drawing Sheets

24
25
23

22
26
28
24
25
23
27
29
21

27
24
210
211

210
211

5
27
211
24
1
2
30
C
4
6
7
8
9
10
P2
P3

REELING APPARATUS

BACKGROUND AND SUMMARY OF THE INVENTION

The present invention relates to reeling apparatus and particularly, but not exclusively to apparatus for reeling cable.

One known form of cable winding apparatus comprises two reels. When one reel is full, winding is automatically transferred to the other. So that various tests can be carried out on the wound cable, it is desirable for a reasonable length of the inner end of the cable to be brought out to the surface of the reel so that various tests can be carried out on the reeled cable. It is difficult to produce an inner end of sufficient length and also difficult to avoid damage to that inner end. An object of the invention is to mitigate or eliminate these disadvantages.

According to the present invention, there is provided apparatus for reeling an elongate object comprising first and second reeling stations, means at each station for winding cable delivered to the station on a reel disposed at that station, means for guiding the element to be wound to one or other of the stations, means for transferring the element from one station to the other when a sufficient length of element has been wound on a reel at the said one station and means at each station for generating a loop in the element at the beginning of winding at that station which provides an inner loose end.

In a preferred embodiment of the invention, the means at each station for generating a loop comprise an eccentric, which on rotation displaces the element being wound from the centre of rotation to create the loop. The eccentric includes a catcher or snagger to hold the element at changeover and a deflector which pushes the element onto the barrel of the reel being wound. The part of the element would around the eccentric then becomes the inner loose end. At the commencement of winding, directly after transfer from one reel to the other, changes of speed of element take place causing initial speed increase followed by speed decrease of the element. It is important that this slack does not effect the normal speed control provided by a conventional accumulator unit. A swinging arm is therefore provided to absorb these changes. This arm is itself provided with both spring and pneumatic position control means. Means, for example, pins or a strip, are provided for restraining ballooning of the element due to centrifugal force during changeover. At the end of winding on the reel after changeover, by rotating the eccentric relative to the reel, the inner end form may be laid on the external surface of the reel. To enable the eccentric to be rotated relative to the reel, a pin which normally locks both together is withdrawn and that catcher is opened to release the elements.

DESCRIPTION OF THE DRAWINGS

In order that the invention may be more clearly understood, one embodiment thereof will now be described, by way of example, with reference to the diagrammatic accompanying drawings, in which:-

FIG. 2(*d*) is an enlarged partial front elevational view of one of the reels in a different position.

FIGS. 5(*a*), 5(*b*) and 5(*c*) are side elevational views showing progressive stages in the movement of one reel in a reel changeover operation for the apparatus of FIG. 1;

FIG. 5(*d*) demonstrates the movement of another part of the apparatus in the changeover illustrated in FIGS. 5(*a*), 5(*b*) and 5(*c*);

FIG. 6(*d*) is a side elevational view corresponding to FIG. 5(*d*) demonstrating the movement of another part of the apparatus during the movement illustrated in FIGS. 6(*a*), 6(*b*) and 6(*c*);

DESCRIPTION OF THE INVENTION

Figure 1:
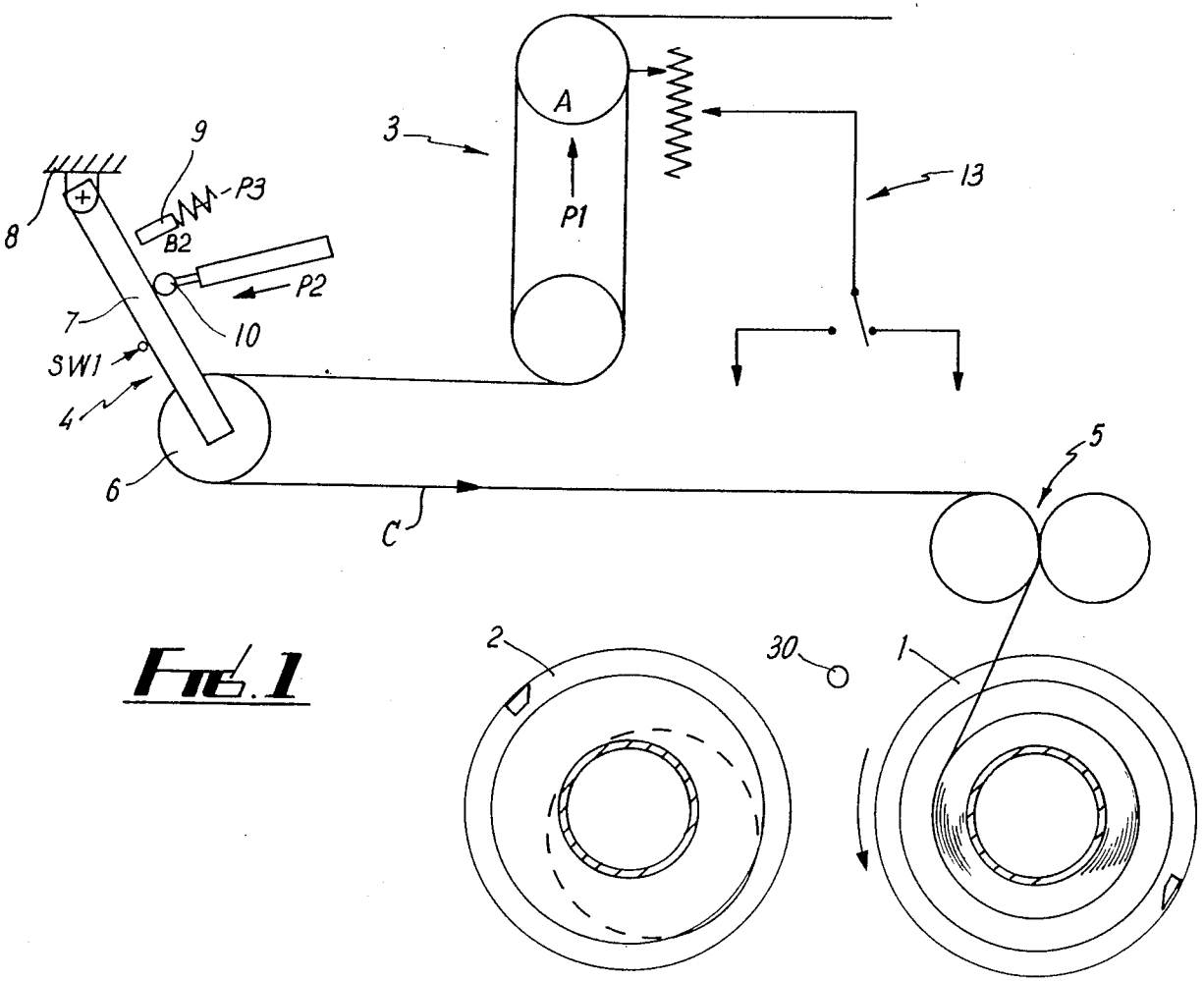
FIG. 1 is a side elevational view of one form of reeling apparatus according to the invention.

Referring to FIG. 1 of the drawings, the reeling apparatus generally comprises reels 1 and 2. The cable, which is referenced C is fed via a control accumulator 3 swinging arm arrangement 4 and wire guide mechanism comprising guide rolls 5 to one of the reels (in the case shown reel 1). The swinging arm arrangement comprises a roller 6 connected rotatably to an arm 7 mounted for pivotal movement about a stationary point 8. The arm 7 is acted upon by a variable spring plunger mechanism 9 and a pneumatic piston and cylinder arrangement 10. In its normal position the arm 7, contacts a switch SW1. The forces exerted by the mechanism 3, 9 and 10 are referenced P1, P2 and P3.

p1 is a loading of the control danger 3 to give the required winding tension of the cable C.

p2 is a loading of the arrangement 10 required to hold the swinging arm 7 in the correct position at switch.

p3 is the loading of the spring plunger B2 which in normal running is zero.

The speed of the rotation of reel 1 is relative to line speed and is trimmed for reel diameter by the control dancer A such that the position of A remains substantially constant by use of a proportional and integral loop control. At this point, reel 2 is stationary.

The accumulator is preferably similar to the one disclosed in the U.S. Pat. No. 2,929,569 to Detrick et al, and it is associated with a conventional feed back speed control unit illustrated generally and diagrammatically at 13. The position of the accumulators controls the electrical current fed to the motor driving either reel 1 or reel 2.

Figures 2A, 2B, 2C, 2D:
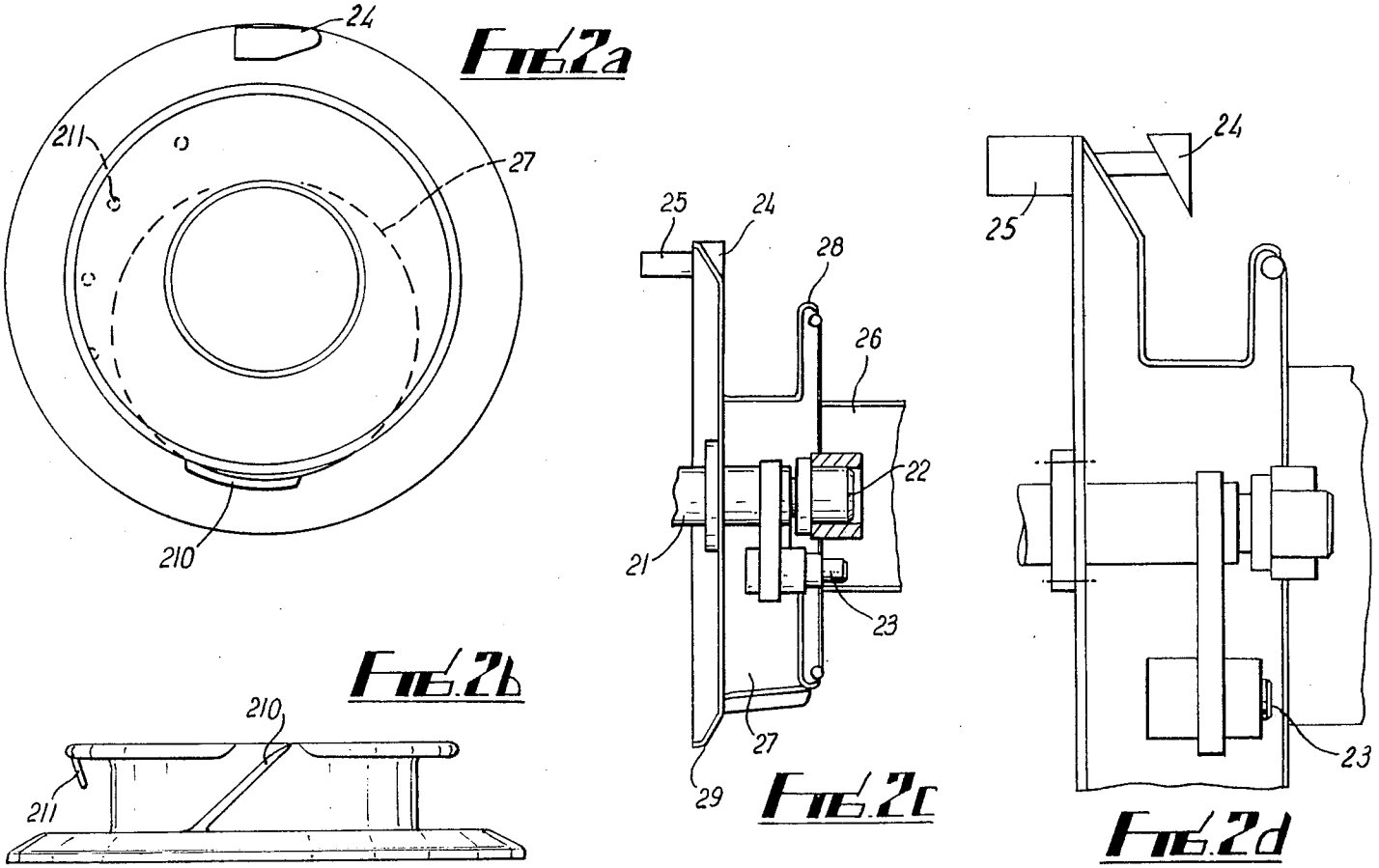
FIGS. 2(*a*), 2(*b*) and 2(*c*) are, respectively, side elevations, plan and part front elevational in section view of one of the reels of the apparatus of FIG. 1.

Reels 1 and 2 are disposed in catcher discs. These discs are specially formed to accept a cable at changeover from one reel to the other. Referring specifically to FIGS. 2(*a*), 2(*b*) and 2(*c*) the disc comprises a drive shaft 21 on which the reel is mounted. A "live" pintle 22 is mounted via bearings onto the drive shaft and a conventional retractable drive pin 23 is also mounted on the drive shaft, the drive pin 23 is being normally disposed in the position illustrated in FIG. 2(*c*) but being retractable by suitable conventional means, such as a pneumatic cylinder, to the position illustrated in FIG. 2(*d*). The disc comprises inner and outer flanges 28 and 29. A conventional cable catcher or snagger mechanism 24 of the general type disclosed in the U.S. Pat. No. 4,438,886 to Meisser and Veyrasset et al, No. 4,451,008 is mounted on flange 29. This mechanism has an associated conventional loading system 25 which is actuatable via conventional means, such as a pneumatic cylinder. The reel itself is referenced 26 and is mounted over the pintel 22.

The disc comprises an eccentric 27 disposed between the two flanges 28 and 29. A deflector 210 is fitted to this eccentric at its major diameter and a series of pins 211 are mounted on the flange 28. The pins 211 could be replaced by a continuous strip. FIG. 2(*c*) shows the catcher or snagger mechanism 24 closed, and the drive pin 23 engaged in the reel 26. FIG. 2(*d*) shows the catcher mechanism 24 open, and the drive pin 23 retracted from the reel 26. In this condition, the reel 26 is free to rotate relative to the catcher disc.

Figure 3:
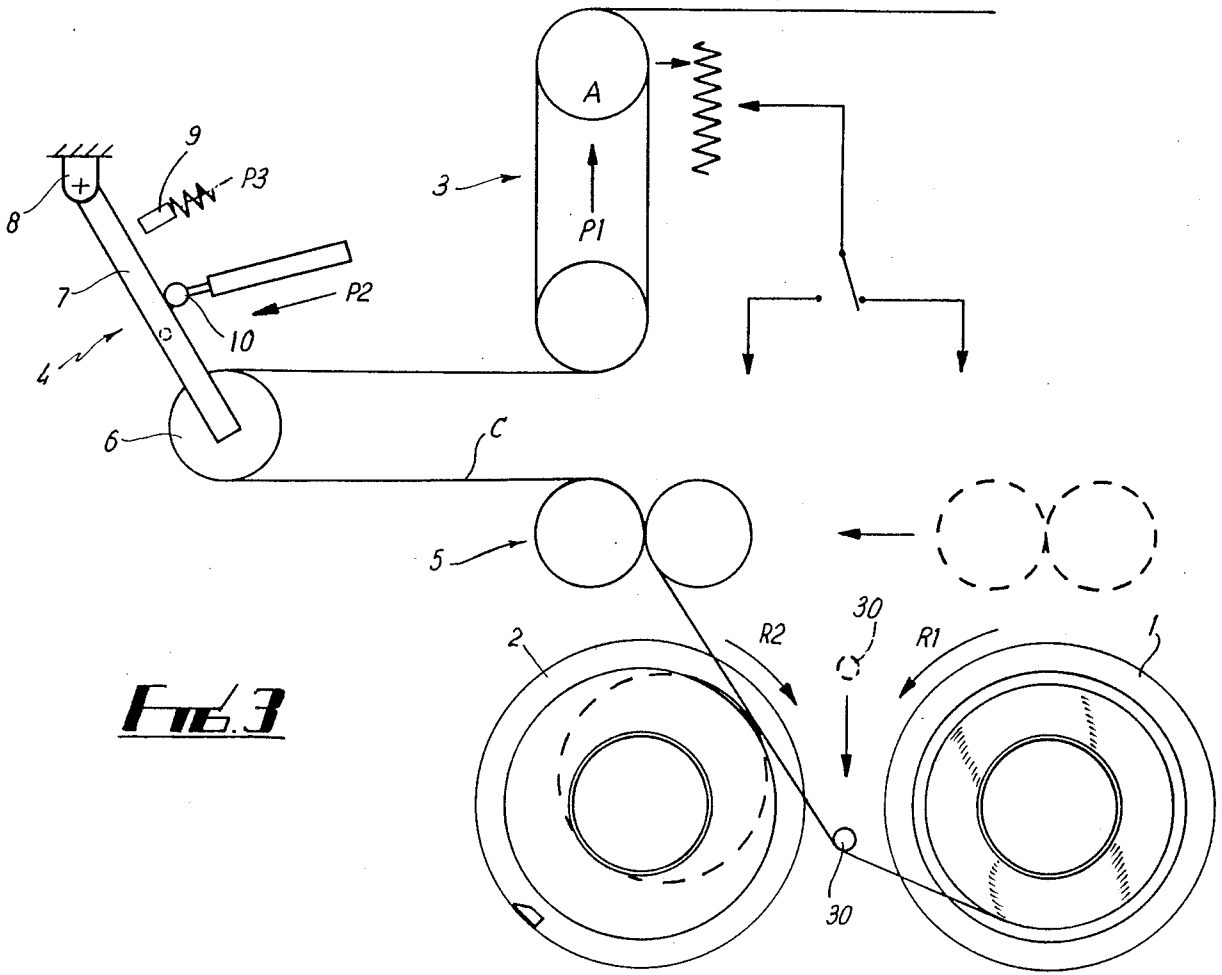
FIG. 3 is a side elevational view of the apparatus of FIGS. 1 and 2 showing the apparatus at changeover from one reel to the other.

FIG. 3 shows the initial sequence at transfer of cable winding from reel 1 to reel 2.

The wire guide mechanism 5, which comprises a conventional traverse of distributor mechanism of the type illustrated in the U.S. Pat. No. 3,368,765, to O'-Grady, moves across to reel 2, and a deflector roll 30 pulls the cable down into the correct position relative to the reel flange.

The loading P2 on arrangement 10 changes to a value such that the swinging arm arrangement 4 is in balance with the control dancer 3, i.e., the tension in the cable C resulting from force P2 applied to the arm arrangement 4 is equal to the tension in the cable C resulting from force P1 applied to the dancer 3. The switch SW1 is operative for controlling the piston and cylinder arrangement 10 to normally return the arm 7 to its normal position wherein it is in contact with the switch SW1. The ratio of P1 and P2 is dependent upon the dynamic effects of the cable and the physical characteristics of the swinging arm. Loading P3 is still at zero and loading P1 is still controlled by the control dancer A.

Reel 2 is accelerated to a speed R2 which is proportional to the radius of the eccentric (FIG. 2).

Speed R2 is in the region of 75–85% of the speed required to match the reel barrel diameter to the line speed, to actual value being dependent upon the ratio of barrel diameter to accentric diameter, and the size of cable being wound. The control dancer 3 is not connected to the drive reel 2.

Figures 4, 5A, 5B, 5C, 5D:
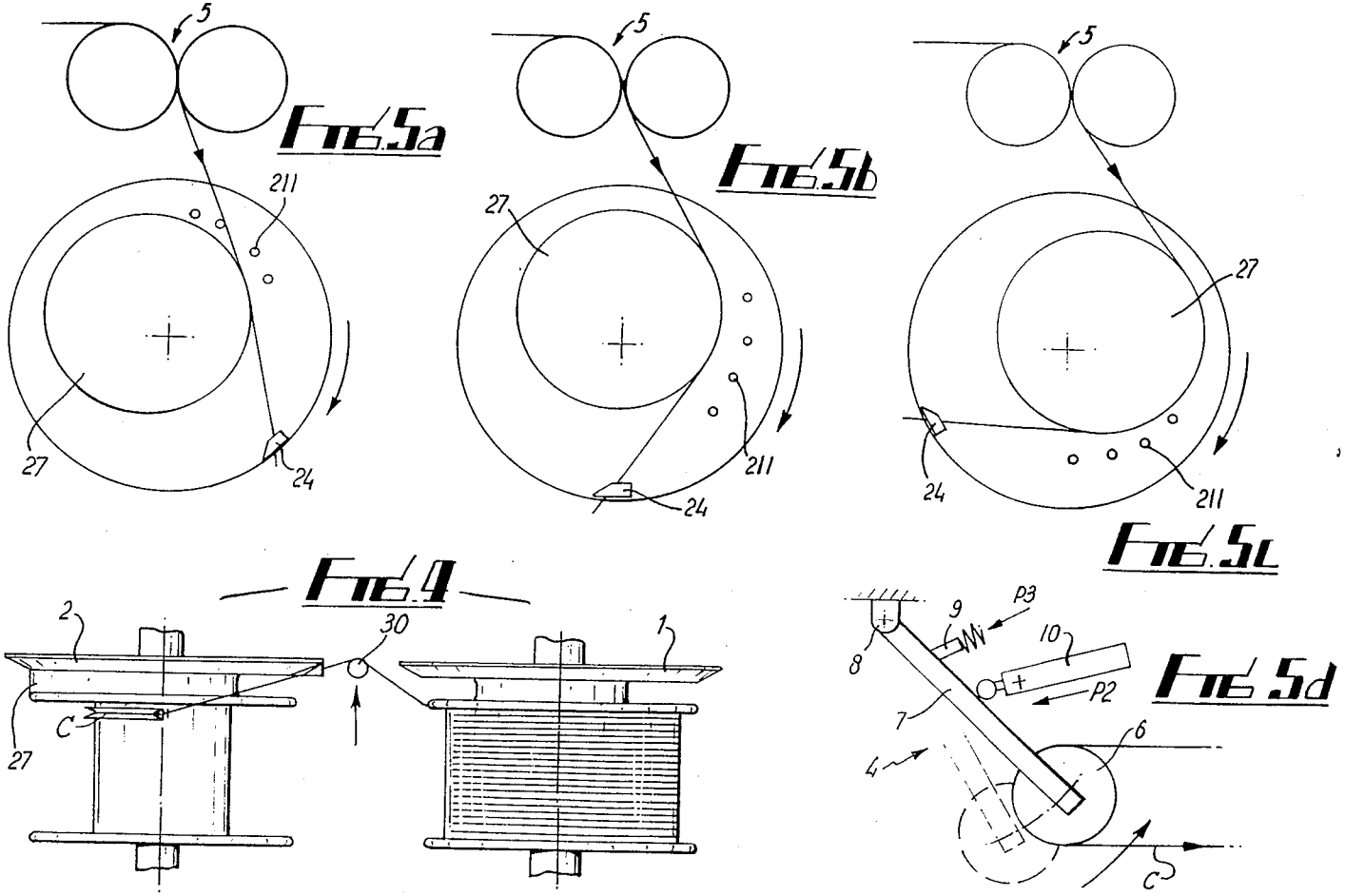
FIG. 4 shows a plan view of the reels of the apparatus of FIG. 1.
Figure 6A:
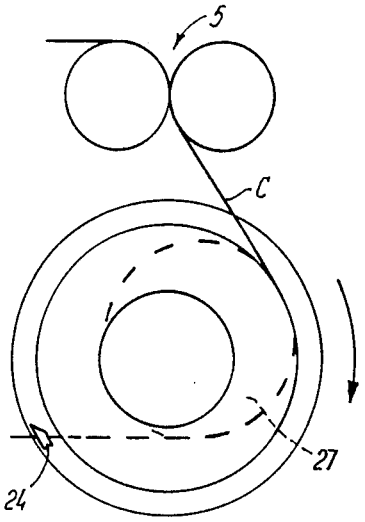
FIGS. 6(*a*), 6(*b*) and 6(*c*) are side elevational views showing further progressive states in the movement of the reel of FIGS. 5(*a*), 5(*b*) and 5(*c*) following changeover.
Figure 6B:
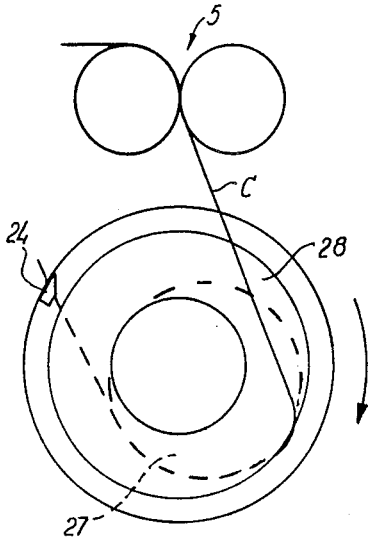
Figure 6C:
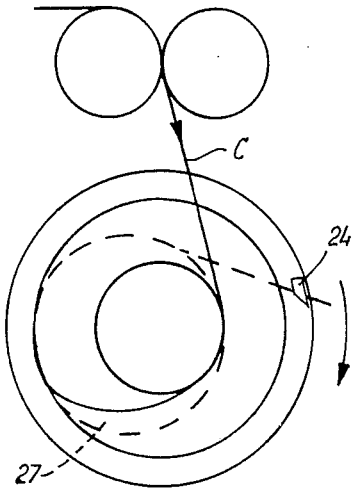
Figure 6D:
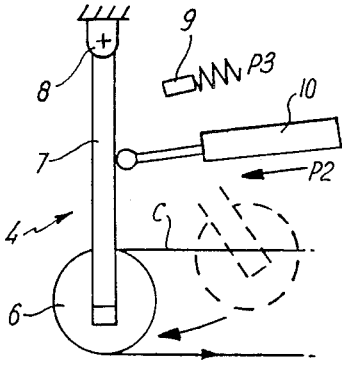

FIG. 4 shows the relative position of cable C and reels 1 and 2 at the moment of transfer of cable 1 winding from reel 1 to reel 2. When the wire guide mechanism 5 reaches the flange of the reel the cable C is deflected by roller 30 moving upwards between the two reels into the path of the catcher mechanism.

At this point, the wire guide 5 is either held in position or is moved out away from the reel, depending upon the type of cable being wound, and the speed of winding. As is known in the art, when winding small diameter highly flexible cables at high speeds it is advantageous to initially move away from the reel to avoid improper initial wrapping whereas when winding longer diameter cables at slower speeds, it is important to start wrapping next to the reel in order to produce a high quality winding. At this moment, reel 2 is accelerated to bring it to a barrel match speed.

FIGS. 5(*a*), 5(*b*) and 5(*c*), respectively, show the progressive positions of the cable C as it is caught in the catcher mechanism 24, and winding commences on reel 2.

The cable C is pulled down onto the eccentric of the catcher disc, is severed and winds around the eccentric 27, over typically half a revolution of the reel 2, and is pulled down to a position under the catcher pins 211, preventing "ballooning" due to centrifugal forces.

FIG. 5(*d*) shows the action of the swinging arm 4 during this time. Due to the change in diameter of the winding surface, a change in linear speed of the cable C takes place. During this time, the swinging arm 4 is pulled back against the force P2, and the arm comes into contact with the spring plunger mechanism 9, causing force P3 to increase.

FIGS. 6(*a*), 6(*b*) and 6(*c*) show the action of the cable C after it has wound around a half revolution of the eccentric 27. On reaching the major diameter of the eccentric, the deflector 210 (FIG. 2) guides the cable C across the eccentric 27 and off the flange 28 (FIG. 2). The cable C then falls into the reel 26 until it reaches the reel barrel (FIG. 6(*b*) and 6(*c*)) where it starts to wind onto the barrel.

FIG. 6(*d*) shows the action of the swinging arm 4 during this operation. During the time that the cable leaves the eccentric 27 (FIG. 5(*a*) to the time that it starts to wind onto the barrel of the reel 26, (FIG. 6(*c*)) the cable C is not being wound, and slack cable is generated between the reel and the dancer unit 3 (FIG. 1). The swinging arm 4 senses this slack via the switch SW1 and under the combined influence of force P2 and P3 moves outwards to take up the slack (see FIG. 6(*d*) and overcome the centrifugal forces on the cable C. Force P3 is present only at the initial movement, in order to assist in acceleration of the arm.

The size of the loop generated in the cable C as it transfers from the catcher disc to the reel barrel is a function of cable weight, tension, speed of rotation, the reaction time of the swinging arm 4, and the acceleration rate of the reel. The values of forces P2 and P3, and the initial speed of the reel 2, together with the acceleration rate are all controlled to give the required size of loop for each cable size and linear speed of winding.

Figure 7:
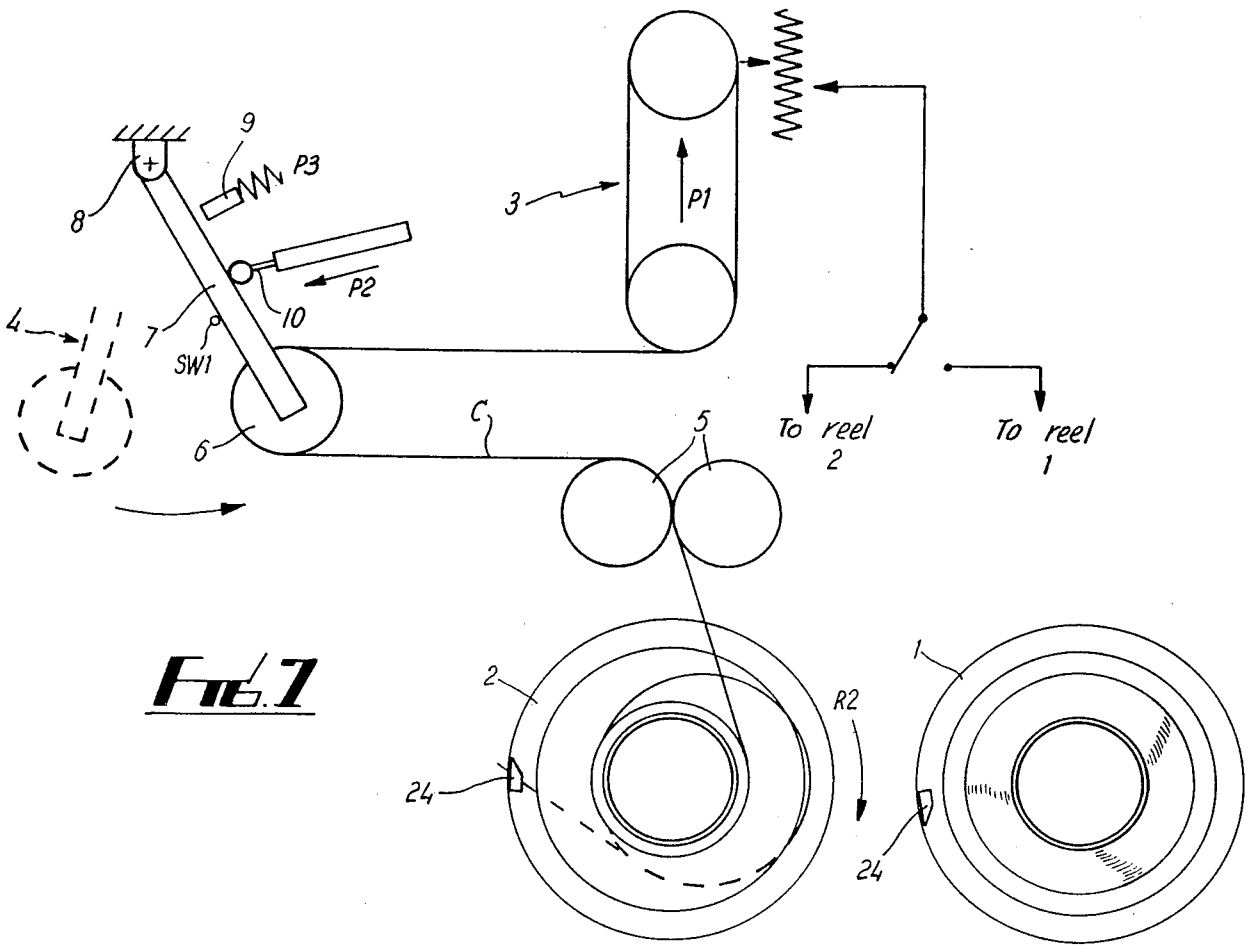
FIG. 7 is a side elevational view of the apparatus of FIG. 1 following reel changeover.

FIG. 7 shows the system after transfer has been completed, and the cable is being wound onto the barrel of reel 2.

After the given time following transfer of winding, the value of P2 is altered to bring the arm 4 to the normal running position relative to SW1, and the dancer control system is switched from reel 1 drive to reel 2 drive to enable control of winding during build up of the reel diameter.

Reel 1 is a braked via conventional means (not shown) to standstill, and is then ready for unloading and an empty reel is loaded.

The machine is then ready to do a transfer of winding from reel 2 to reel 1 when winding is complete on reel 2.

Figure 9C:
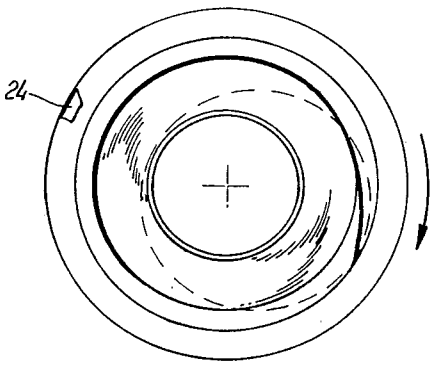
FIGS. 9(*a*), 9(*b*) and 9(*c*) are plan views corresponding to FIGS. 8(*a*), 8(*b*) and 8(*c*), respectively.
Figure 8C:
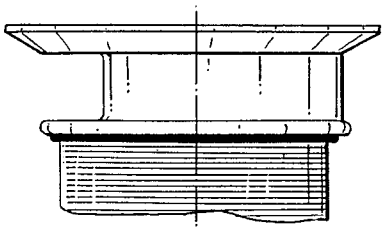
FIGS. 8(*a*), 8(*b*) and 8(*c*) are side elevational views showing progressive stages at the end of a reeling operation on the reel illustrated in FIGS. 5(*a*) and 6(*a*)
Figure 9B:
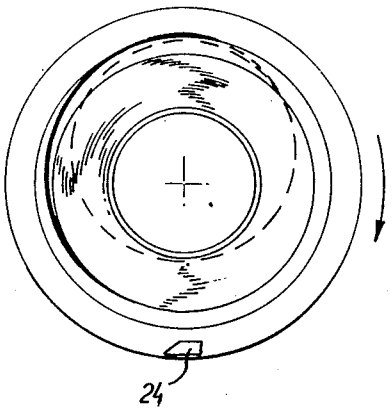
Figure 8B:
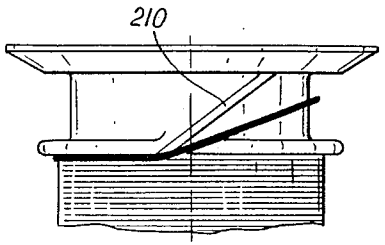
Figure 9A:
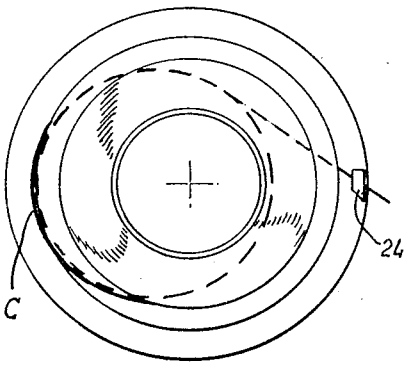
Figure 8A:
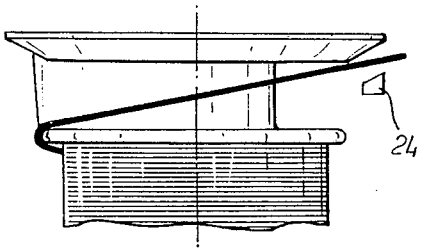

FIGS. 8(*a*), 8(*b*) and 8(*c*) and FIGS. 9(*a*), 9(*b*) and 9(*c*) show the method of dealing with the inner end loop during unloading.

In order to facilitate reel handling, and avoid damage to the inner end, it is desirable to have this wound onto the reel and not hanging loose.

This is achieved during the unloading cycle as shown in FIGS. 8(*a*), 8(*b*) and 8c) and FIGS. 9(*a*), 9(*b*) and 9(*c*) (for reel 2). The inner end is shown in heavy line in these figures. The reel and catcher disc are rotated in the same direction as when winding, until the catcher is in the position shown in FIGS. 8(*a*) and 9(*a*).

At this point the catcher mechanism 24 is opened, releasing the cable C from the catcher, and the drive pin 23 is retracted from the reel, see FIG. 2(*d*).

The reel is then prevented from rotating, and the catcher disc continues to rotate in the same direction (FIGS. 8(*b*) and 8(*c*) and FIGS. 9(*b*) and 9(*c*).

The deflector 210 pushes the inner end loop across the flange of the catcher disc causing it to fall onto the top of the cable wound on the reel FIGS. 8(*c*) and 9(*c*).

Due to the length of the end, it lies over the drum and the reel can be removed without damage to the loose end.

It will be appreciated that the above embodiment has been described by way of example only and that many variations are possible without departing from the invention.

What is claimed is:

1. Apparatus for reeling an elongate element comprising a plurality of reeling stations, a reel at each of said stations, each reel having an axis of rotation, means at each of said stations for winding said elongate element on the reel disposed at that station when said elongate element is delivered thereto, means for selectively guiding the elongate element to be wound to one of the stations, means for transferring the elongate element from one station to another station when a sufficient length of the elongate element has been wound on the reel at said one station and means at each station for generating a loop in the elongate element at the beginning of winding at that station which provides an inner loose end, the means for generating a loop comprising an eccentric which is rotatable by winding means at that station for displacing the elongate element being wound from the axis of rotation at that station to create a loop.

2. Apparatus as claimed in claim 1, in which the eccentric includes a catcher to hold the element at changeover and a deflector which pushes the element onto the barrel of the reel being wound.

3. Apparatus as claimed in claim 2, in which means are provided for looking the eccentric relative to the reel being wound, the means being releasable to allow the eccentric to be rotated relative to the reel to allow the inner loose end to be laid on the external surface of the wound reel.

4. Apparatus as claimed in claim 3, in which the means for looking comprises a withdrawable member and the catcher is arranged on withdrawal of the member to release the element being wound.

5. Apparatus as claimed in claim 1, in which means are provided for increasing and decreasing the speed of the element at commencement of winding onto a reel.

6. Apparatus as claimed in claim 5, in which a swinging arm is provided to absorb changes in speed of the element.

7. Apparatus as claimed in claim 6, in which the swinging arm is provided in position control means.

8. Apparatus as claimed in claim 1, in which means are provided for restraining ballooning of the element due to centrifugal force during changeover.

9. Apparatus as claimed in claim 1, in which an element speed control comprising a dancer unit is provided.

* * * * *

UNITED STATES PATENT AND TRADEMARK OFFICE

CERTIFICATE OF CORRECTION

PATENT NO. : 4,979,687

DATED : December 25, 1990

INVENTOR(S) : BIRCH, Keith

It is certified that error appears in the above-identified patent and that said Letters Patent is hereby corrected as shown below:

Cover page, at "[22]", change "filed Feb. 8, 1989" to --filed Feb. 6, 1989--.

Signed and Sealed this

Tenth Day of November, 1992

*Attest:*

DOUGLAS B. COMER

*Attesting Officer*

*Acting Commissioner of Patents and Trademarks*